US008395557B2

(12) United States Patent
Goins et al.

(10) Patent No.: US 8,395,557 B2
(45) Date of Patent: Mar. 12, 2013

(54) BROADBAND ANTENNA HAVING ELECTRICALLY ISOLATED FIRST AND SECOND ANTENNAS

(75) Inventors: Matthew G. Goins, San Marcos, CA (US); Allan C. Goetz, La Jolla, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 1871 days.

(21) Appl. No.: 11/741,466

(22) Filed: Apr. 27, 2007

(65) Prior Publication Data

US 2012/0229361 A1 Sep. 13, 2012

(51) Int. Cl.
*H01Q 1/28* (2006.01)
*H01Q 9/16* (2006.01)

(52) U.S. Cl. ..... 343/708; 343/793; 343/700 MS; 343/893; 343/850

(58) Field of Classification Search ..... 343/708, 343/712, 793, 700 MS, 795, 801, 826, 829
See application file for complete search history.

(56) References Cited

U.S. PATENT DOCUMENTS

| | | | | |
|---|---|---|---|---|
| 5,341,148 | A | 8/1994 | Walter et al. | |
| 5,825,332 | A | 10/1998 | Camacho et al. | |
| 6,075,496 | A * | 6/2000 | Harriman | 343/821 |
| 6,094,171 | A | 7/2000 | Riddle et al. | |
| 6,097,343 | A | 8/2000 | Goetz et al. | |
| 6,175,336 | B1 | 1/2001 | Coughlin et al. | |
| 6,198,446 | B1 | 3/2001 | Goetz et al. | |
| 6,222,499 | B1 | 4/2001 | Goetz et al. | |
| 6,653,980 | B2 | 11/2003 | Ceccom et al. | |
| 6,768,461 | B2 * | 7/2004 | Huebner et al. | 343/700 MS |
| 6,836,256 | B2 * | 12/2004 | Hung | 343/790 |
| 6,891,512 | B2 * | 5/2005 | Chadwick | 343/773 |
| 7,327,318 | B2 * | 2/2008 | Frank et al. | 343/700 MS |
| 7,394,428 | B1 * | 7/2008 | Hsieh | 343/700 MS |
| 7,965,238 | B2 * | 6/2011 | Rikuta et al. | 343/700 MS |
| 2007/0241981 | A1 * | 10/2007 | Thudor et al. | 343/793 |
| 2007/0279286 | A1 * | 12/2007 | Coutts et al. | 343/700 MS |

OTHER PUBLICATIONS

Schantz, H.G.; Beeler, W.; Dickson, D.; , "UWB planar bulbous dipole antennas," Antennas and Propagation Society International Symposium, 2005 IEEE , vol. 2A, No., pp. 475-478 vol. 2A, Jul. 3-8, 2005 found at, URL: http://ieeexplore.ieee.org/stamp/stamp.jsp?tp=&arnumber=1551848&isnumber=33056.*

* cited by examiner

*Primary Examiner* — Hoang V Nguyen
*Assistant Examiner* — Amal Patel
(74) *Attorney, Agent, or Firm* — Tarolli, Sundheim, Covell & Tummino LLP

(57) ABSTRACT

A broadband antenna includes a first antenna element having first and second ends spaced apart by a surface thereof. A second antenna element is substantially co-planar with the first antenna element, the second antenna element having first and second ends spaced apart by a surface thereof. The first end of the second antenna element is spaced apart from the second end of the first antenna element by a first air gap. A conductive structure is spaced apart from the first end of the first antenna element by a second air gap, the conductive structure being configured to provide for structural excitation of the antenna over a lower frequency range of an available broadband antenna bandwidth, such as may be a continuous operating bandwidth.

14 Claims, 5 Drawing Sheets

BROADBAND ANTENNA HAVING ELECTRICALLY ISOLATED FIRST AND SECOND ANTENNAS

TECHNICAL FIELD

This invention relates to communications and, more particularly, to a broadband antenna.

BACKGROUND

Various types of antenna structures have been developed to pick-up or to radiate radio-frequency (RF) or other electromagnetic (EM) waves. An antenna system can iv configured to operate in a given antenna bandwidth to meet particular application requirements. Generally, the complexity of designing an appropriate antenna tends to increase when the antenna size as well as other parameters operate to constrain the antenna design.

As one example, a conformal antenna can be constructed and integrated within a vehicle structure, such as an aircraft. The conformal antenna can be implemented as a load bearing or as non-loadbearing structure, for example. More recently, conformal loadbearing structure excitation antennas have been developed for use on tactical aircraft. While such structures can provide an efficient use of the available "real estate" on the aircraft, such existing conformal antennas usually cannot cover all of the communications bands needed for certain applications.

As a further example, modern manned and unmanned tactical aircraft require radio communications over multiple frequency bandwidths. These radio frequency bandwidths generally include the VHF frequency modulation (FM) band (30-88 MHz), the VHF amplitude modulation (AM) band (118-174 MHz) and the UHF band (225-400 MHz). Known antenna systems used on tactical aircraft for Communication Navigation and Identification (CNI) functions have typically included blade antennas that have a fin protruding from the surface of the aircraft. Generally, multiple blade antennas are required for the CNI functions including one for the VHF/FM frequency band, one for the VHF/AM frequency band and another one for the UHF frequency band.

There remains a need for a broadband antenna that can be efficiently packaged for use in tactical aircraft as well as other vehicles or other non-vehicular structures.

SUMMARY

This invention relates to communications and, more particularly, to a broadband antenna. For instance, the antenna can employ structural excitation of an associated structure to which the antenna is coupled.

One aspect of the invention provides a broadband antenna that includes a first antenna element having first and second ends spaced apart by a surface thereof. A second antenna element is substantially co-planar with the first antenna element, the second antenna element having first and second ends spaced apart by a surface thereof. The first end of the second antenna element is spaced apart from the second end of the first antenna element by a first air gap. A conductive structure is spaced apart from the first end of the first antenna element by a second air gap, the conductive structure being configured to provide for structural excitation of the antenna over a lower frequency range of an available broadband antenna bandwidth, such as may be a continuous operating bandwidth.

Another aspect of the invention provides an antenna system that includes a non-conductive substrate having a substantially planar and elongate surface. A conductive structure is fixed relative to the surface of the substrate and configured for attachment to conductive support associated with the antenna system. A first antenna element is fixed relative to the surface of the substrate and has first and second ends spaced apart by a surface thereof. The first end of the first antenna element is spaced apart from an adjacent end of the conductive structure by a first air gap that defines a first port. A second antenna element is fixed relative to the surface of the substrate and has first and second ends spaced apart by a surface thereof. The first end of the second antenna element is spaced apart from the second end of the first antenna element by a second air gap that defines a second port. The first port and the second port cooperate to provide the antenna system with a continuous operating bandwidth.

Yet another aspect of the invention provides an antenna system that includes a non-conductive substrate having a substantially planar and elongate surface. A conductive structure is fixed relative to the surface of the substrate and configured for attachment to a conductive support associated with the antenna system. A first antenna element is fixed relative to the surface of the substrate and has first and second ends spaced apart from each other by a surface thereof. The first end of the first antenna element is spaced apart from an adjacent end of the conductive structure by a first air gap that defines a first port. A second antenna element is fixed relative to the surface of the substrate and has first and second ends spaced apart from each other by a surface thereof. The first end of the second antenna element being spaced apart from the second end of the first antenna element by a second air gap that defines a second port. The first port and the second port cooperate to provide the antenna system with a continuous operating bandwidth that includes VHF frequencies and UHF frequencies. An electrically conductive portion of a support structure (e.g., a vehicle, a man pack or a fixed structure or building) is connected with the conductive structure of the antenna, such that the first port employs the electrically conductive portion of the support structure to provide for structural excitation thereof over at least a substantial portion of the VHF frequencies of the continuous operating bandwidth.

DETAILED DESCRIPTION

Figure 1:
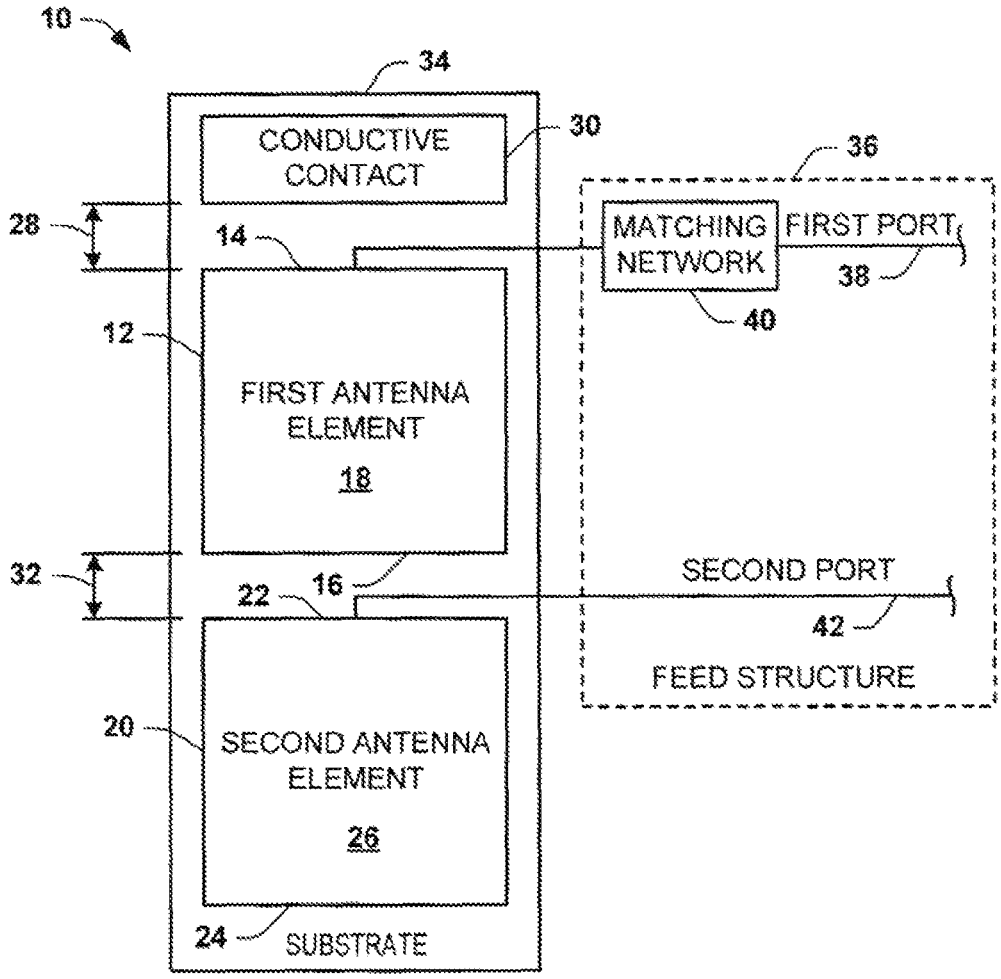
FIG. 1 depicts an example of an antenna system in accordance with an aspect of the invention.

FIG. 1 depicts an example of an antenna system 10 that can be implemented according to an aspect of the invention. The antenna system 10 includes a first antenna element 12 having a first end 14 and a second end 16 spaced apart from each other by a substantially planar body portion thereof 18. The antenna system 10 also includes a second antenna element 20 having a first end 22 spaced apart from a second end 24 by a length of a substantially planar body portion 26. Each antenna element 12, 20 can be formed, for example, of a substantially planar or flat sheet of an electrically conductive material, such as copper, aluminum or other conductive material. Each of the respective body portions 18 and 26 of the antenna elements thus can be substantially coplanar and be formed of the same or different conductive material.

A first air gap 28 spaces apart a conductive contact structure 30 from the first end 14 of the first antenna element 12. It will be appreciated that the term "air gap" does not require that air be the medium between the conductive parts of the antenna system 10, as other insulating materials, including solids, liquids and gases, could be utilized (e.g., the antenna structure can be encapsulated by an insulating material). The conductive contact structure 30 can be formed of the same or a different electrically conductive material as the respective antenna elements 12 and 20. The second antenna element 20 is also spaced apart from the first antenna element by a second air gap 32. The dimensions of the first and second air gaps 28 and 32 can be the same or different. The respective air gaps further can be configured according to the desired frequency response of the antenna system 10.

Each of the first antenna element 12 and the second antenna element 20 can be electrically isolated from each other by a non conductive substrate 34. The substrate 34, for example, can be implemented as a substantially flat sheet of a suitable dielectric material, such as the type of material utilized to make printed circuit boards (e.g., a woven glass reinforced laminate or a non-woven glass reinforced laminate). Those skilled in the art will appreciate various appropriate dielectric or insulating materials that can be utilized to provide the substrate 34 a substantially fiat dielectric constant over the broadband range of frequencies that the antenna system 10 will operate.

As one example, the antenna elements 12 and 20 can be formed by etching a conductive layer disposed on the substrate 34. Alternatively, antenna elements can be formed from a thin sheet (e.g., a foil) of an electrically conductive material and secured to the substrate 34, such as by an adhesive. Regardless of its construction, the substrate 34 operates as means for fixing the relative orientation and arrangement of the antenna elements 12 and 20. The conductive contact structure 30 can be formed on the substrate 34 in a manner similar to the respective antenna elements 12 and 20 (e.g., by etching or attachment to the surface of the substrate). In the example of FIG. 1, the conductive contact portion 30 is illustrated as being attached to the substrate 34 and spaced apart by the first antenna element by the lint air gap 28. The substrate 34 thus can operate to maintain the relative orientation and arrangement of the conductive contact structure relative to the antenna elements 12 and 20 (e.g., including the first air gap 28). Those skilled in the art will understand and appreciate that the conductive contact portion can be a separate structure (e.g., not attached to or formed on the substrate 34) provided that the appropriate air gap 28 between the conductive portion and the first end 14 of the antenna element 12 is maintained within design tolerances.

The conductive contact structure 30, for example, can be electrically connected with an electrically conductive structure of a vehicle or other body (not shown) that might carry the antenna system 10. Alternatively, the conductive contact portion 30 can be implemented itself as the vehicle body portion or other conductive structure, provided that the appropriate air gap 28 is maintained. As used herein, the term "vehicle" is intended to encompass aerial vehicles (e.g., air craft, helicopters, space crafts, and the like), terrestrial vehicles (e.g., cars, trucks, motorcycles and the like), and water crafts (e.g., boats, ships, submarines and the like). It will be appreciated that the antenna system can be provided for use in other types of portable structures (e.g., man packs) as well as at fixed structures (e.g., a building) in addition to vehicles.

By way of further example, the antenna system 10 provides for structural excitation of a low band frequency at a port defined by the first air gap 28. Such structural excitation at the low frequency port is achieved by electrically connecting the conductive contact portion 30 to a vehicle or other conductive structure to which the antenna system 10 is mounted. The structural excitation enables the conductive contact portion 30 and the vehicle body and/or other conductive structure to radiate current over the structure and thereby provide for a low and frequency operation (e.g., in the very high frequency (VHF) and such as from about 30 MHz to about 300 MHz). The antenna system 10 includes a feed structure 36 configured to transmit or receive RF or other waves relative to the antenna including at the first port defined by the first air gap 2.

The first antenna element 12 also forms part of a dipole antenna structure in conjunction with the second antenna element 20. That is, the first antenna element 12 is shared between frequency hands such that the dimensions of the antenna system 10 can be reduced relative to many existing antenna structures. As a dipole antenna structure, excitation of the second band is achieved at the second port defined by the second air gap 32 between the first antenna element and second antenna element. This second port can be accessed by the feed structure 36. Advantageously, the configuration of the antenna system 10 allows the antenna to operate over a continuous bandwidth over a range of frequencies, such as from about 20 MHz to about 3 GHz (e.g., providing a bandwidth ratio of 100:1). This is in sharp contrast to many existing antenna structures that operate in multiple discrete bands—not over a continuous operating bandwidth as the antenna system 10.

The feed structure 36 can include a first port 38 that can be conductively coupled to the first antenna element 12 at the first air gap 28, such as through a matching network 40. The matching network 40 can be configured with an impendence that is matched to impendence of the structure (e.g., vehicle or other portable or fixed structure) to which the conductive contact portion 30 is attached. The matching network 40 can be included as part of the antenna system 10. Alternatively, the matching network 40 can be implemented separately as an external matching network. The matching network 40 can be specifically designed with an impedance for each given application or, alternatively, an appropriate impendence can be designed to provide for an appropriate level of performance over a range of intended applications.

A second port 42 can be electrically connected to the second antenna element 20, such as at the first end 22 adjacent to the second air gap 32. The feed structure 36 can be utilized to provide a dual port feed structure. Alternatively, the first port 38 and second port 42 can be provided to a RF combiner (not shown) to provide for a single port operation over the continuous bandwidth supported by the antenna system 10. The ports 38 and 42 can connect to appropriate electronics (not shown), which may vary according to application requirements.

In view of the discussion with respect to FIG. 1, those skilled in the art will understand and appreciate various shapes and configurations of antenna elements that can be utilized. For example, the antenna elements 12 and 20 can be circular, elliptical, rectangular or other shapes that can be determined (e.g., by simulation or empirical trials) to provide operations over a desired range of frequencies. Advantageously, the antenna elements 12 and 20 can be sufficiently thin (e.g., formed of an electrically conductive foil or etched out of a sheet of material disposed on a thin sheet of a substrate 34), such that the antenna can be attached to an appropriate structure of a vehicle, such as an aerial vehicle (e.g., manned or unmanned), a terrestrial vehicle, a portable housing (e.g., a man pack) or other fixed or portable structure as may be understood according to design requirements.

Figure 2:
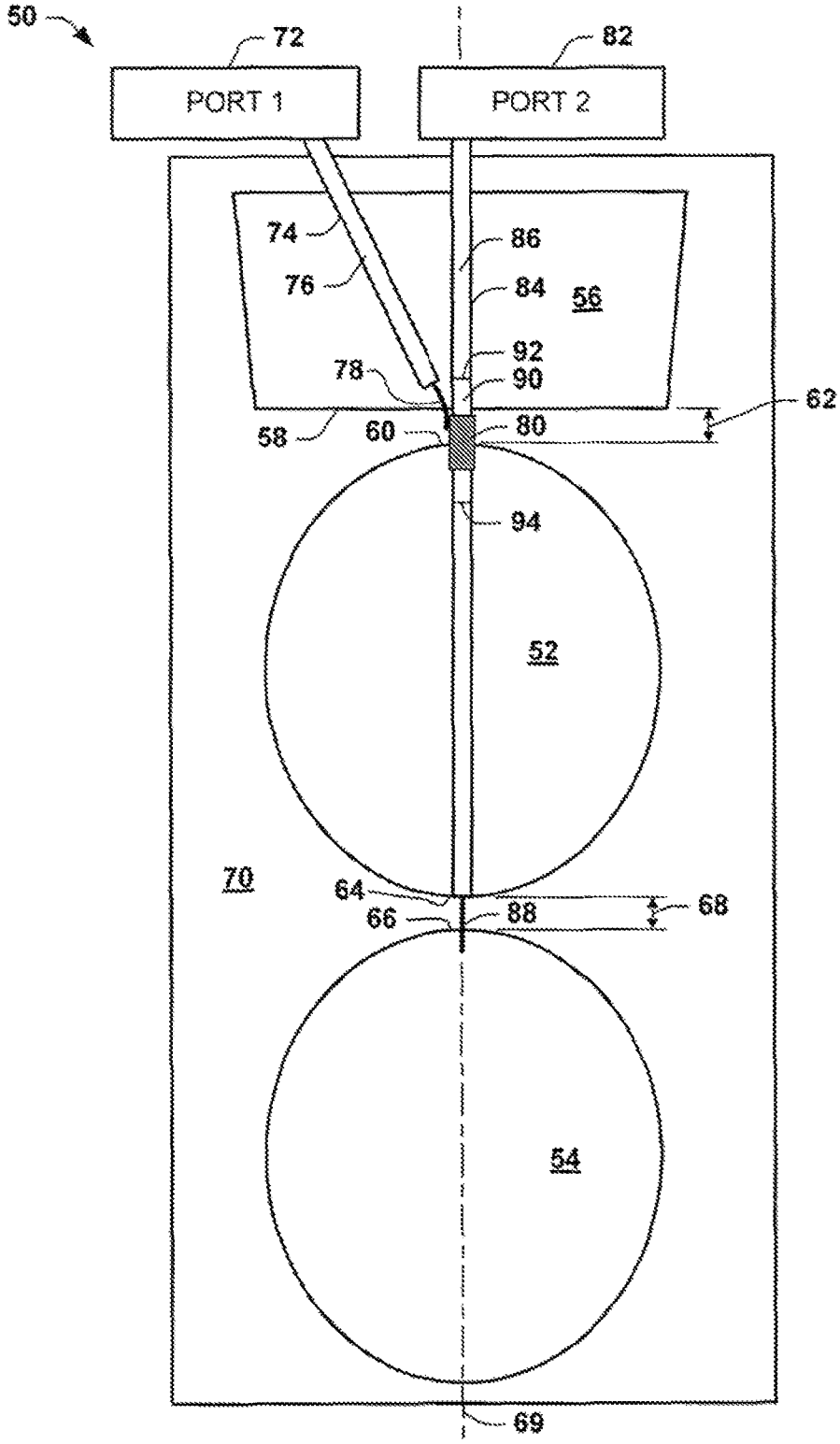
FIG. 2 depicts an example of one embodiment of an antenna system in accordance with an aspect of the invention.

FIG. 2 depicts an example of an antenna system 50 that can be implemented according to an aspect of the invention. The antenna system 50 includes antenna elements 52 and 54 that are substantially flat sheets of conductive material. The antenna element 52 is interposed between the antenna element 54 and a conductive structure 56. The conductive structure 56 has an end 58 that is spaced apart from an adjacent end 60 of the first antenna element 52 by an air gap 62. Similarly, a second end 64 of the first antenna element 52 is spaced apart from an adjacent end 66 of the second antenna element 54 by an air gap 68. The air gaps 62 and 68 can be the same or different distance depending upon application requirements and the frequency response required by the antenna system 50. Each of the air gaps 62 and 68 defines a respective port of the antenna system 50. In the example of FIG. 2, each of the antenna elements 52 and 54 are symmetric relative to each other about a central line of symmetry 69 extending longitudinally through the antenna. The antenna elements 52 and 54 can also have the same dimensions and configuration, as depicted as ellipses in FIG. 2, although they alternatively could be differently sized and shaped elements. The antenna configuration can provide for an omni-azimuth radiation pattern, for example.

Each of the antenna elements 52 and 54 as well as the conductive structure 56 are fixed in orientation relative to each other by their attachment to a non-conductive substrate 70. For example, the non-conductive substrate 70 can be a sheet of a non-conductive material, such as a sheet of a dielectric material. The thickness of the antenna structure, including the antenna elements 52 and 54, conductive portion 56 and non-conductive substrate 70, can be kept quite thin, such as to a thickness of one-half inch or less (e.g., $1/8^{th}$ inch).

The antenna system 50 provides a first port 72, corresponding to as low frequency port, at the air gap 62 between the conductive structure 56 and the antenna element 52. The feed portion for the antenna system 50, for example, can include a coaxial cable 74 having an outer shield 76 of an electrically conductive material and an internal conductor 78 that is electrically isolated from the outer shield. The conductor 78 is electrically connected (e.g., by soldering or other means of attachment, such as conductive adhesive) to an exterior of an electrically conductive tube (or cylindrical member) 80. The conductive tube 80 is electrically connected at the end 60 of the antenna element 52, such as by soldering. As a result, the port 72 can be electrically connected with a center part of the first antenna element 52 at the first end 60 through its connection to the electrically conductive tube 80.

A second port 82 can be electrically connected at the first end 66 of the second antenna element 54 to provide access to the port defined by the second air gap 68. For instance, the second port 82 can be electrically connected with the end 66 of the first antenna by a length of a coaxial cable 84. The coaxial cable 84 includes an outer shield 86 and a central conductor 88 that is electrically isolated from the outer shield 86. In the example of FIG. 2, the coaxial cable 84 extends through an interior of the electrically conductive tube 80 along a center line portion of the antenna element 52 with the outer shield terminating near the second end 64 of the first antenna element 52. The conductor 88 thus can extend from the termination of the shield and connect at the first end 66 of the second antenna element 54 adjacent the air gap 68. Since the outer shield 86 of the coaxial cable 84 is electrically conductive, an appropriate electrically non-conductive coating or layer can be attached along an exterior of the length of the cable 84 over which the tube 80 is positioned. The insulating material 90, for example, can extend over the outer shield 84 from a location 92 near the end 58 of the conductive structure 56 to a location 94 that is beyond the distal end of the conductive tube 80 and spaced from the end 60 of the antenna element 52. In this way, the conductive tube 80 is electrically isolated from the outer shield 86 of the coaxial cable 84, such that the electrical connection of the conductor 88 to the antenna element 54 is enhanced.

In the configuration in the antenna system 50, the conductive structure 56 can be conductively attached to a conductive body portion of a vehicle or other structure to which the antenna is mounted. As a result, the first port 72 can employ structural excitation of the conductive structure 56 and the conductive body portion to which it is attached to enable radiation of frequencies within the lower frequency bandwidth (e.g. VHF frequencies) supported by the first port of the antenna system 50. Current can also radiate on the outer shield 76 for excitation associated with the first port 72. The first port 72 can also be provided to an appropriate matching network (not shown) to facilitate structural excitation via the port 72.

The second port 82 utilizes a dipole configuration of the first element 52 and the second element 54 for excitation over a range of higher frequencies (e.g., UHF frequencies) supported by the antenna system. The first element 52 thus is used for structural excitation of the low frequency (e.g., VHF) port defined by the first air gap 62 as well as defines a dipole element to provide for excitation at the higher frequencies via the port defined by the second air gap 68 in conjunction with the second antenna element 54. Since the first antenna element 52 is shared by the first port 72 and by the second port 82, as described herein, the antenna system 50 can support a continuous band of operation over the two ports. Additionally, while two ports 72 and 82 are schematically depicted in FIG. 2 as being separate, the ports can be combined to provide a single port that can support operation over the entire continuous bandwidth of the antenna system. As one example, the antenna system 50 can provide for an approximate bandwidth of greater than 100:1 over a continuous frequency range from about 20 MHz to about 3 GHz.

Figure 3:
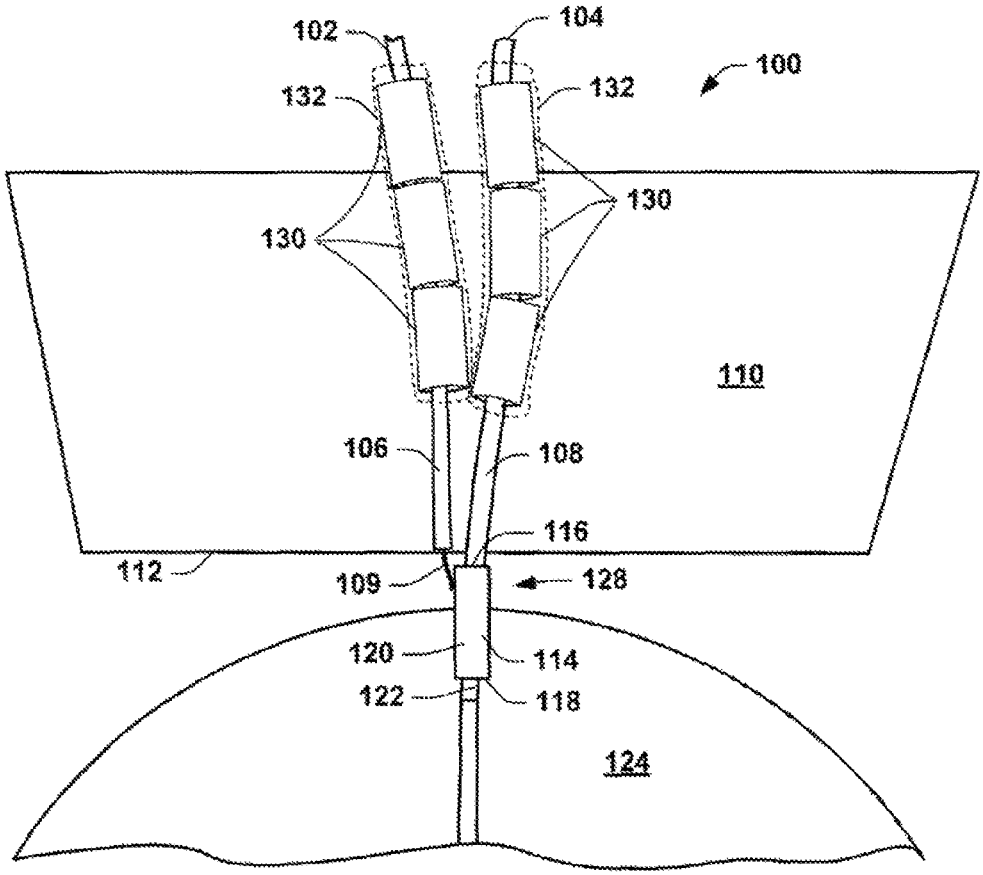
FIG. 3 depicts an example of a feed structure that can be part of an antenna in accordance with an aspect of the invention.

FIG. 3 depicts an example of part of a feed structure 100 that can be utilized for excitation of a continuous bandwidth supported by an antenna system incorporating such structure. The feed structure 100 includes a pair of coaxial cables 102 and 104. Each cable 102 and 104 includes a conductive outer shield 106 and 108 that is electrically isolated from central conductor 109 thereof. Each of the outer shields 106 and 108 of the coaxial cables 102 and 104 can be attached to a conductive contact portion 110, such as by soldering or an appropriate conductive adhesive or other mounting means. The first coaxial cable 102 terminates adjacent a second end 112 of the conductive contact portion 110. The conductor 109 extends from the second end 112 and is electrically connected to an electrically conductive tube 114. The tube 114 can include a first end 116 and a second end 118 spaced apart by a cylindrical sidewall 120 of an electrically conductive material.

By way of further example, an interior sidewall of the tube 114 can be electrically isolated from the outer shield 106 of the coaxial cable 104 by a layer of a non-conductive material 122. The non-conductive material 122 can be a coating, tape or other layer of insulating material that is applied over the outer shield 106 of the conductive coaxial cable 104. For instance, the non-conductive material 122 can extend along a length of the cable 104 over which the tube 114 is expected to be placed.

The tube 114 can be secured to the antenna element 124 (e.g., by soldering) at a central location such that the end 116 of the tube is spaced apart from the end 112 of the conductive contact portion 110 at an air gap 128 extending between the conductive portion and the antenna element. The conductive tube 114 thus allows the coaxial cable 104 for the second port to pass through the tube for serving efficiently as the port for the high frequency portion of the antenna system. The tube 114 further serves as the feed for the low frequency port of the antenna system. That is, the tube thus provides dual functions associated with operation over both supported frequency bands in the continuous operating bandwidth of the antenna.

Since electrical current will radiate along the outer shield of the coaxial cables 102 and 104, ferrite beads (or other RF-absorptive members or material) 130 can be applied over the exterior of the coaxial cables to attenuate unwanted currents from re-radiating on the outer shields of such cables. To help maintain the position of the ferrite beads 130 relative to the coaxial cables 102 and 104, an outer layer of sleeve of material, indicated as dashed lines 132, can be applied over the ferrite beads. Those skilled in the art will understand and appreciate various types of materials that can be applied to maintain the relative position of the ferrite heads 130, which can include coverings or non-conductive adhesive materials interposed between the beads and the cables 102 and 104.

Figure 4:
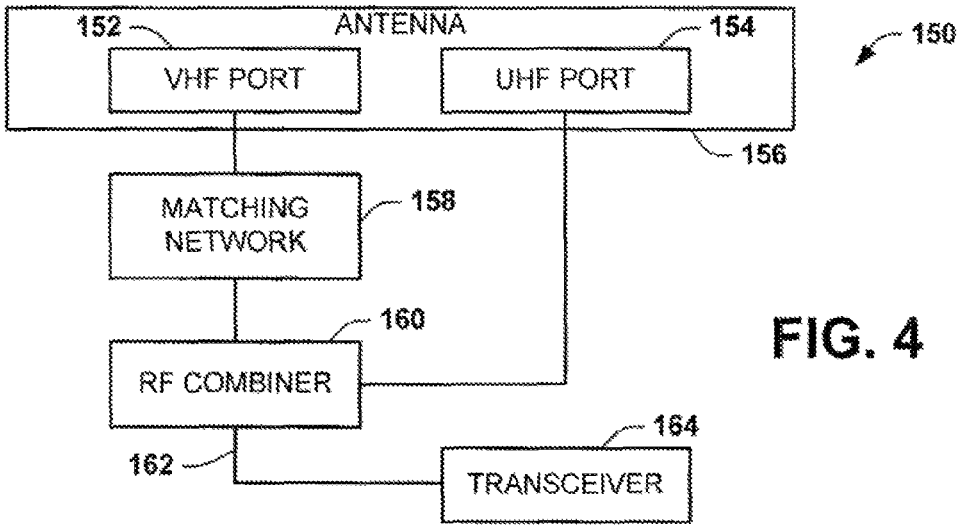
FIG. 4 is a block diagram of an antenna system and electronics that may be implemented in accordance with an aspect of the invention.

FIG. 4 depicts an example of part of an antenna system 150, including electronics that can be utilized for receiving or sending signals according to an aspect of the invention. The antenna system 150 includes a pair of ports depicted schematically as including a VHF port 152 and a UHF port 154. Each of the ports 152 and 154 provides for operation over a respective portion of a continuous band of operation. The ports 152 and 154 correspond to feed points of an antenna structure 156 for receiving and/or transmitting signals over the respective bands supported by the antenna system 150. The VHF port 152 and the UHF port 154 can be electrically connected at respective locations of an antenna structure 156 such as described herein. The continuous band of operation can vary according to configuration and arrangement of antenna elements and associated air gaps provided for excitation thereof, which may be determined based on application requirements. For example, the VHF port 152 can be utilized for VHF frequencies (e.g., from about 20 MHz to about 300 MHz) and the UHF port can be utilized for UHF frequencies (e.g., from about 300 MHz to about 3 GHz).

The VHF port 152 provides for an operation in a lower frequency of the continuous bandwidth. As described herein, the VHF port can utilize structural excitation to enhance operation at the lower bandwidth by radiating current through conductive portions of an antenna and the conductive structure to which the antenna is attached. A matching network 156 can be coupled to the VHF port 152 for impendence matching of the port relative to the structure being excited for such low band operation. The matching network 156 can be provided as part of the antenna structure or, alternatively, an external matching network can be provided.

In the example of FIG. 4, the VHF port 152, through the matching network 156, and the UHF port 154 are coupled to an RF combiner 158. The RF combiner 158 is utilized to combine the signals propagating to or from the respective ports 152 and 154 and provide a common, single port 160. The single port 160 thus can be coupled to a transceiver 162 as well as other antenna electronics (not shown). In this way, the antenna system 150 shown and described herein can be implemented as a single port antenna that provides continuous band of operation over the continuous band supported by the two ports 152 and 154. It will be understood and appreciated, however, that the output of the matching network and the UHF port can be employed to provide dual port operation for the antenna system 150 over the continuous bandwidth.

Figure 5:
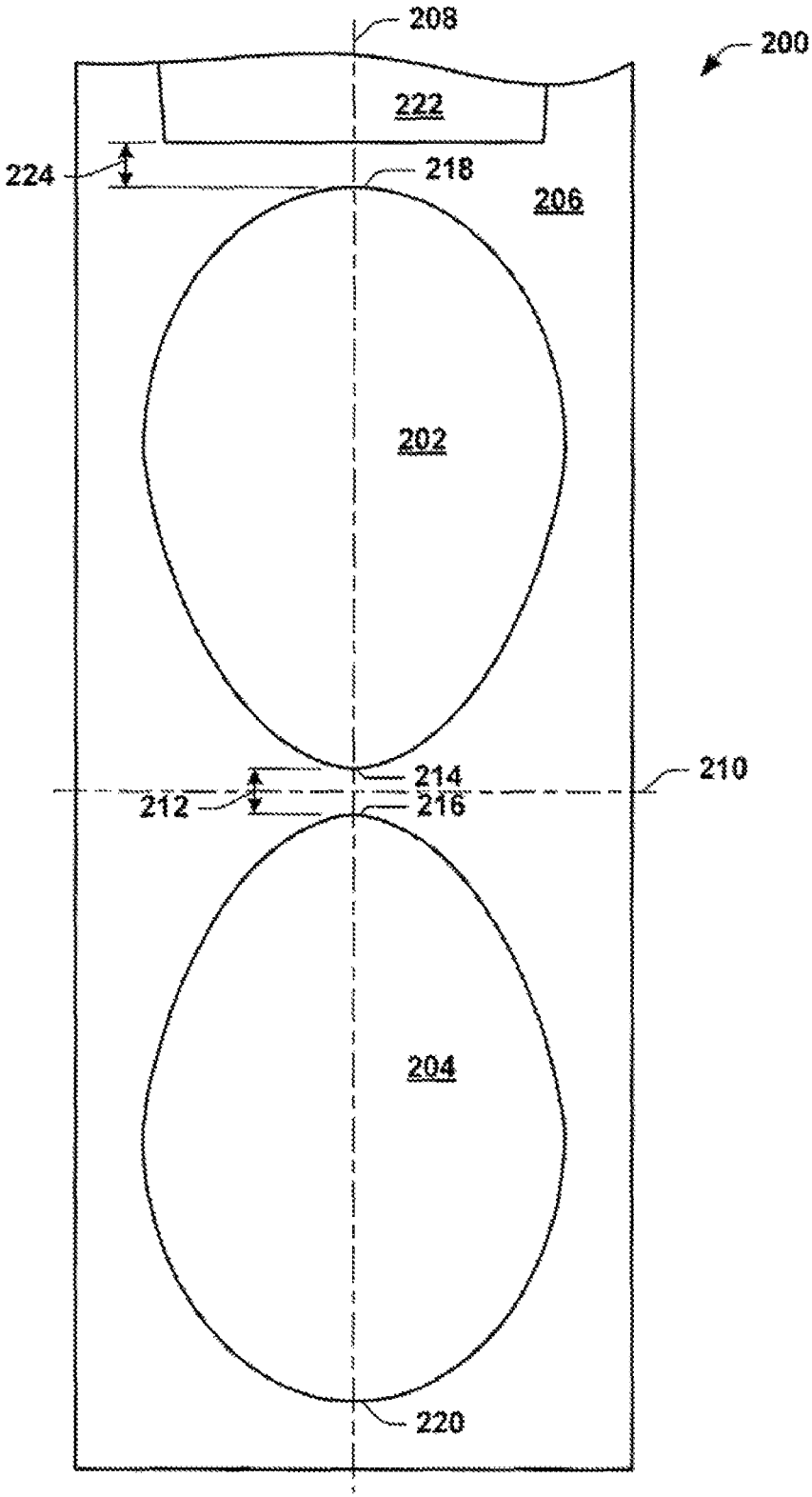
FIG. 5 depicts an example of part of an antenna depicting antenna elements that can be implemented according to an aspect of the invention.

FIG. 5 depicts an example of part of an antenna structure 200 that can be employed in an antenna system according to an aspect of the present invention. The antenna structure 200 includes antenna elements 202 and 204. In the example of FIG. 5 the antenna elements 202 and 204 are attached to a non-conductive substrate 206, such as a sheet of a dielectric material described herein. For purposes of explanation, a first line of symmetry 208 extends longitudinally through a center of the antenna elements 202 and 204 demonstrating the symmetrical nature of each antenna element relative to such line. Additionally, a second line of symmetry 210 is depicted as extending laterally across the substrate intermediate to each of the antenna elements substantially perpendicular to the first line of symmetry 208. For instance, the line of symmetry 210 extends through a center of an air gap 212 between adjacent ends 214 and 216 of the respective antenna elements 202 and 204. Each of the antenna elements 202 and 204 further are symmetrical relative to each other about the lateral line of symmetry 208. That is, each of the antenna elements 202 and 204 can be the same dimensions and configuration and oriented symmetrically relative to each other about the lateral line of symmetry 210 and the longitudinal line of symmetry 208.

In the example of FIG. 5, each of the antenna elements 202 and 204 is depicted as being substantially oval or egg-shaped having a smaller radius of curvature at adjacent ends 214 and 216 thereof and a greater radius of curvature at respective distal ends 218 and 220 thereof (e.g., ovals with only one axis of symmetry). The distal end 218 of the antenna element 202 also is spaced apart from a conductive structure 222 by an air gap 224. The length of the air gap 212 and the air gap 224 can be the same, although they may be different depending on application requirements.

The particular dimensions and configurations of the respective antenna elements can vary according to application requirements and the frequency response desired for the antenna structure 200. As one example, the lateral dimension of the antenna elements 202 and 204 can be in a range from about 4 inches to about 5 inches (e.g., approximately 4.5 inches) and the air gaps 212 and 224 can each be in a range from about 0.2 to about 0.3 inches (e.g., approximately 0.25 inches) to provide for a continuous operating and from about 20 MHz to about 3 MHz. Those skilled in the art will understand and appreciate that, through simulation or other analysis, different dimensions and configurations of antenna elements and air gaps may be utilized to achieve operation over one or more other bands.

Figure 7:
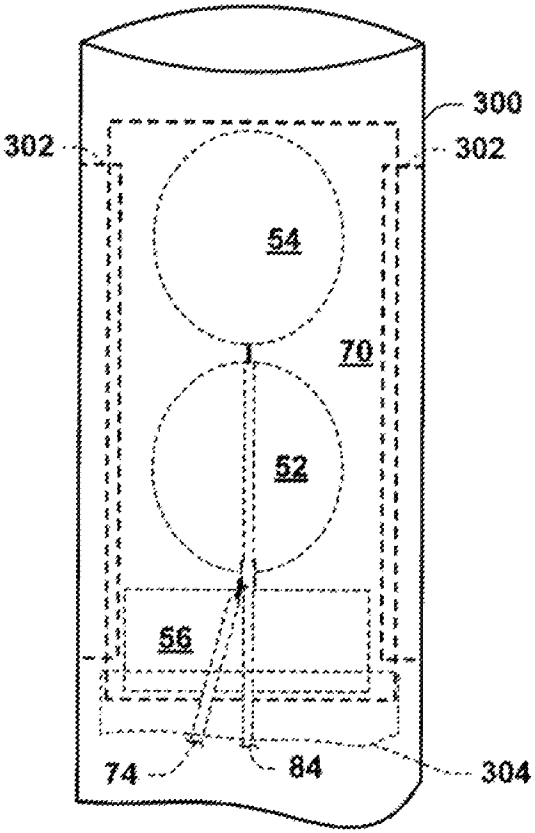
FIG. 7 depicts an example of an antenna mounted within an enclosure in accordance with an aspect of the invention.
Figure 6:
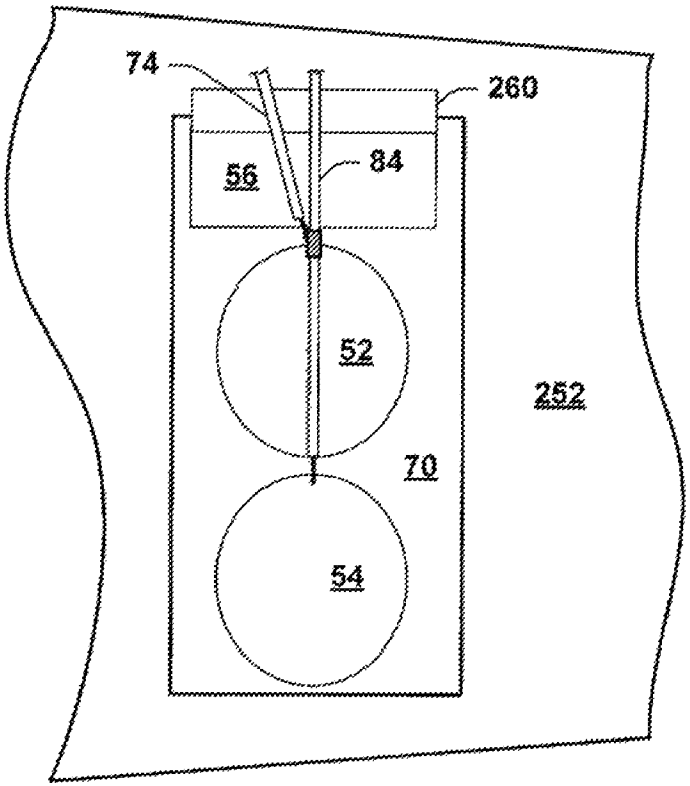
FIG. 6 depicts an example of an antenna attached to a portion of a vehicle in accordance with an aspect of the invention.

FIGS. 6 and 7 depict two example uses of antenna systems that can be implemented according to an aspect of the invention. For simplicity of explanation, the antenna systems in FIGS. 6 and 7 will refer to the example antenna system 50 shown and described with respect to FIG. 2, such that reference numbers introduced with respect to FIG. 2 will refer to corresponding parts of the antenna in FIGS. 6 and 7. It will be understood and appreciated that other configurations of antenna systems, according to an aspect of the invention, can be utilized in similar arrangements on various structures. Moreover, the example structures to which an antenna may be attached, as depicted in FIGS. 6 and 7 are provided for purposes of illustration and various other structures and arrangements of structures can be used.

Referring to FIG. 6, an example of the antenna system 50 (FIG. 2) mounted to a surface of a conductive structure 252 is shown. The structure 252 may be part of a vehicle (e.g., aerial, terrestrial or water craft). By way of examples the structure 252 may correspond to a wing of an aerial vehicle (e.g., manned or unmanned). As described above, the antenna system 50 includes a conductive structure 56 and antenna elements 52 and 54 arranged in a manner such as shown and described in the example of FIG. 2. Those skilled in the art will understand and appreciate other configurations and arrangements of antenna elements in conducting structures that can be implemented based on the teachings contained herein.

In the example of FIG. 6, the conductive structure 56 of the antenna system 50 is conductively coupled to the conductive structure 252 of the vehicle, such as by a length of a conductive tape, foil or other material, indicated schematically at 260, which can be applied to conductively couple such structures. Those skilled in the art will appreciate various other means for conductively coupling the conductive structure of the antenna with the conductive portion of the vehicle, including, for example, bolts, screws, welding, soldering, adhesive materials, tape or combinations thereof. The respective ports of the antenna system 50 can be further conductively coupled to appropriate electronics is coaxial cables (or other conducting members), depicted at 74 and 84.

FIG. 7 depicts an example of an embodiment of an antenna system 50 that can be mounted within a cylindrical enclosure 300 according to another embodiment of the invention. The enclosure 300 can include means for retaining the antenna system 50 at a desired, substantially fixed orientation within the enclosure. As one example, the retaining means may include a bracket 302 extending longitudinally along opposed sides of an interior of the enclosure. The bracket 302, for example, can include a longitudinally extending, slit that receives side edges of the substrate 70. Additionally or alternatively, a laterally extending bracket for other electrically conductive means, e.g., conductive tape, screws, bolts, adhesives, foil, etc.) 304 can be attached at an end of the antenna system 50. The bracket 304 can also electrically connect the conductive antenna structure 56 to corresponding conductive structure associated with the enclosure 300. Such corresponding structure, for example, may include a vehicle housing or shell, a chassis, or a combination of these and/or other electrically conductive supports that can radiate current over a lower frequency range (e.g., VHF) of the operable antenna bandwidth. As a result, the bracket 304 can electrically couple with additional structure (e.g., corresponding to conductive structure of a vehicle or other structure to which the enclosure 300 is associated and/or the enclosure itself) to provide for structural excitation of at a low frequency range of the antenna bandwidth. The bracket 304 can extend into the enclosure 300 or be located external to the enclosure for attachment to the conductive structure 56 of the antenna system 50. Additionally or alternatively, an electrical connection may be made to corresponding part of a vehicle or other body portion (e.g., a facility, or man pack frame) via the longitudinal brackets 302.

Those skilled in the art will understand and appreciate that the particular configuration and size of conductive attachment may be customized for a given application. Additional attachment means (e.g., screws, bolts, adhesives and the like—not shown) can also be employed to hold the antenna system 50 at a desired orientation within the enclosure 300. The enclosure 300, for example, can be arranged to appear as an exhaust pipe or other structure having a similar shape or appearance.

What has been described above includes exemplary implementations and embodiments of the invention. It is, of course, not possible to describe every conceivable combination of components or methodologies for purposes of describing the invention, but one of ordinary skill in the art will recognize that many further combinations and permutations of the invention are possible. Accordingly, the invention is intended to embrace all such alterations, modifications and variations that fall within the scope of the appended claims.

What is claimed is:

1. A broadband antenna, comprising:

a first antenna element having first and second ends spaced apart by a surface thereof;

a second antenna element that is substantially co-planar with the first antenna element, the second antenna element having first and second ends spaced apart by a surface thereof, the first end of the second antenna element being spaced apart from the second end of the first antenna element by a first air gap; wherein the first antenna element and the second antenna element comprise substantially flat coplanar sheets of electrically conductive material separated by the first air gap;

a conductive structure spaced apart from the first end of the first antenna element by a second air gap, the conductive structure being configured to provide for structural excitation of the antenna over a lower frequency range of an available broadband antenna bandwidth;

a feed structure comprising:

a first feed path coupled to the first antenna element for at least one of providing or receiving radio frequency power relative to a first port defined by the second air gap; and a second feed path coupled to the second antenna element for at least one of providing or receiving radio frequency power relative to a second port defined by the first air gap, each of the first feed path and the second feed being coupled to a combiner to provide a common port for at least one of transmitting or receiving radio frequency power relative to the antenna over a continuous operating bandwidth of the antenna; and a conductive tube attached to and extending from the first end of the first antenna element, the second feed path passing through an interior of the conductive tube.

2. The antenna of claim 1, wherein the first feed path comprises a coaxial cable having an outer conductive shield that is conductively attached to the conductive structure and having a conductor that is conductively coupled to the conductive tube.

3. An antenna system, comprising:

a non-conductive substrate having a substantially planar and elongate surface;

a conductive structure fixed relative to the surface of the substrate and being configured for attachment to a conductive support associated with the antenna system;

a first antenna element fixed relative to the surface of the substrate having first and second ends spaced apart by a surface thereof, the first end of the first antenna element being spaced apart from an adjacent end of the conductive structure by a first air gap that defines a first port;

a second antenna element fixed relative to the surface of the substrate having first and second ends spaced apart by a surface thereof, the first end of the second antenna element being spaced apart from the second end of the first antenna element by a second air gap that defines a second port, the first port and the second port cooperating to provide the antenna system with a continuous operating bandwidth, wherein the first antenna element and the second antenna element comprise substantially flat and substantially coplanar sheets of electrically conductive material separated by the second air gap;

a conductive tube connected to and extending from a central part of first end of the first antenna element;

a first feed path for the first port being electrically connected with the conductive tube; and a second feed path for the second port passing through an interior of the conductive tube and connecting with the first end of the second antenna element.

4. The system of claim 3, wherein each of the first antenna element and the second antenna element having substantially identical oval geometric shapes with a longitudinal dimension thereof oriented along a line of symmetry extending longitudinally through the substrate and extending through centers of the first antenna element and the second antenna element.

5. The antenna of claim 1, wherein the antenna bandwidth is a continuous bandwidth over a range of radio frequencies.

6. The antenna of claim 5, wherein the range of radio frequencies is from about 20 MHz to about 3 GHz.

7. The antenna of claim 1, further comprising a sheet of a non-conductive substrate having a substantially planar surface, the first antenna element and the second antenna element arranged on the substantially planar surface of the substrate along a longitudinal line of symmetry that extends longitudinally through the substrate.

8. The antenna of claim 7, wherein each of the first antenna element and the second antenna element comprise a substantially flat sheet of an electrically conductive material.

9. The antenna of claim 8, wherein the first antenna element and the second antenna element have substantially the same dimensions and configuration.

10. The antenna of claim 8, wherein the first air gap and the second air gap are substantially the same.

11. The antenna of claim 8, wherein each of the first antenna element and the second antenna element are elliptical having a longitudinal dimension oriented along the longitudinal line of symmetry.

12. The antenna of claim 11, wherein each of the first antenna element and the second antenna element are configured as having substantially identical oval geometric shapes of the electrically conductive material, each of the first antenna element and the second antenna element being oriented with a smaller radius of curvature at adjacent ends thereof and a larger radius of curvature at distal ends thereof.

13. The system of claim 3, wherein the continuous operating bandwidth is provided over frequencies in a range from about 20 MHz to about 3 GHz.

14. The system of claim 3, further comprising an electrically conductive portion of an associated support structure electrically connected with the conductive structure, such that the first port employs the electrically conductive portion of the associated support structure to provide for structural excitation thereof over a range of lower frequencies in the continuous operating bandwidth.

* * * * *